United States Patent [19]

Harding

[11] 4,257,603

[45] Mar. 24, 1981

[54] HOOP AND ADJUSTABLE TARGET GAME

[76] Inventor: Larry R. Harding, Box #112, Beaverville, Ill. 60912

[21] Appl. No.: 46,359

[22] Filed: Jun. 7, 1979

[51] Int. Cl.[3] ..... A63F 3/00

[52] U.S. Cl. ..... 273/126 R; 46/220

[58] Field of Search ..... 273/126 R, 126 A, 85 R, 273/127 B, 127 R, 118 R, 118 A, 118 D, 108, 119 R, 119 A, 54 D; 46/220

[56] References Cited

U.S. PATENT DOCUMENTS

| | | | |
|---|---|---|---|
| 1,119,673 | 12/1914 | Bellamy | 273/126 R |
| 1,191,330 | 7/1916 | Marley | 273/126 R |
| 1,300,526 | 4/1919 | Watson | 273/126 R |
| 2,662,518 | 12/1953 | Luthi | 273/119 R |
| 2,887,320 | 5/1959 | Gravelle et al. | 273/126 R |
| 3,094,330 | 6/1963 | Smith | 273/54 D |
| 3,105,685 | 10/1963 | Jahn | 273/54 D |
| 3,135,514 | 6/1964 | Ohrent | 273/126 R |
| 3,482,837 | 12/1969 | Myers et al. | 273/126 R |
| 3,575,416 | 4/1971 | Cooper | 273/126 R |
| 4,166,620 | 9/1979 | Sheppard | 273/126 R |

*Primary Examiner*—Richard C. Pinkham
*Assistant Examiner*—T. Brown
*Attorney, Agent, or Firm*—Evan D. Roberts

[57] ABSTRACT

A game adapted for play on a table of the table tennis type comprising a central barrier having section movable progressively inwardly as a hoop is rolled between them by each of several players.

5 Claims, 3 Drawing Figures

HOOP AND ADJUSTABLE TARGET GAME

SUMMARY

A game for two or more players in which a barrier is provided for mounting transversely in the center of a table of the table tennis type, the barrier having inner sections progressively movable towards each other to decrease the size of the gap there between, each player, or players, on each side being given the opportunity, in turn, to spin a hoop through the barrier opening at a predetermined gap. After each player has moved the hoop through the gap at a particular opening, or gap, the gap is decreased in size by moving inner barrier sections incrementally inwardly so that the center line of the barrier is coextensive with the center line of the gap. It is preferred that the hoops be skidded, with a slight backspin, so as to obtain maximum effective control.

DESCRIPTION OF THE PREFERRED EMBODIMENT

Figure 1:
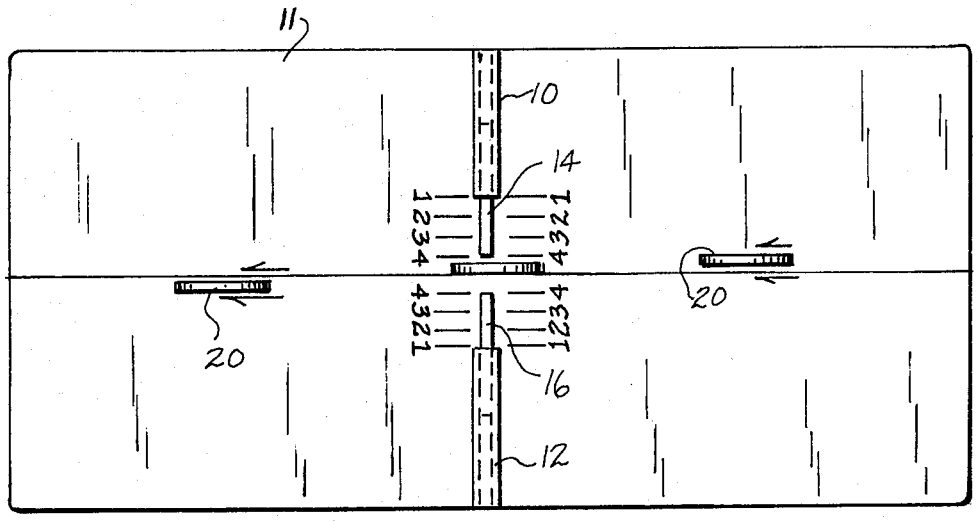
FIG. 1 is a plan view of the game in the present invention illustrated in connection with a conventional table of the table tennis type.
Figure 2:
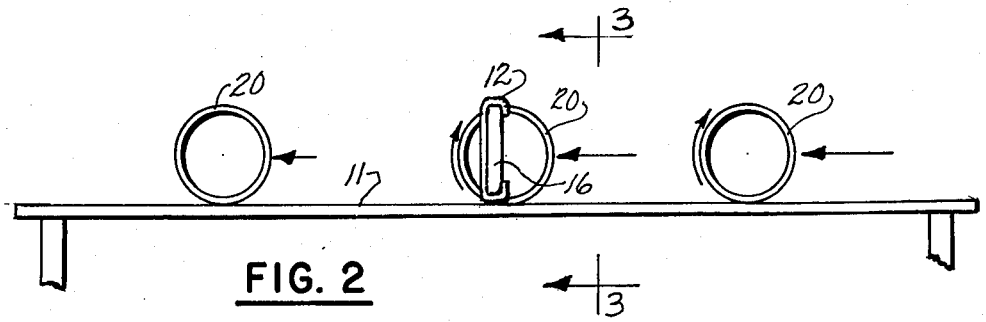
FIG. 2 is a fragmentary elevational view as viewed from the bottom of FIG. 1.

Referring now to the drawings and more particularly to FIG. 1, the game of the present invention includes a barrier having a primary portion or section 10 adapted to be removably secured, by any suitable means, to a table 11 of the table tennis type, and a primary portion or section 12 in alignment with the portion 10. The portions 10 and 12 are of generally C configuration, as shown best in FIG. 2.

Figure 3:
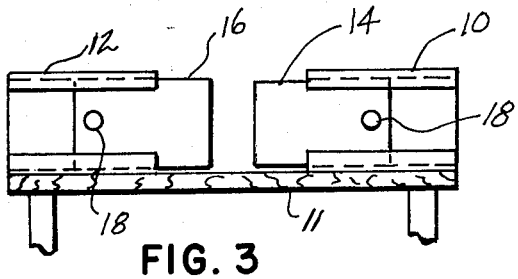
FIG. 3 is an elevational sectional view taken substantially on line 3—3 of FIG. 2.

Slideably received in the portion 10 is a movable gate 14 section. In like manner, a movable gate section 16 is slideably received in the portion 12. As seen best in FIG. 3 the gates 14 and 16 are provided with finger openings 18 to facilitate movement with respect to the fixed members from a position in which the inner edge of each of the gates 14 and 16 are coincident with the inner edges of the portions 12 and 14. When the gates are in their openmost position a player standing at one end of the table 10 rolls and/or skids a hoop 20 through the gap between the confronting edges of the gates 14 and 16 into the hands of the player at the opposite end of the table. The second player, or players, then skids and/or rolls the hoop back to the first player for that particular width of opening of gates 14 and 16 After all players have completed their turn a position 1, for instance, the gates are then moved to position 2 and the first player, or players, proceeds to roll a hoop 20 preferably with a skidding backspin, through the gap between gates 14 and 16 to the player or players at the opposite end of the table. When all players have taken their turn gates 14 and 16 are then moved to position 3 thus narrowing the gap and making the passage of the hoop more difficult. The first player who spins the hoop that collides with the gate or any other part of the barrier is disqualified and his opponent wins the game.

The game of the present invention exhibits important advantages over games of skill heretofore known. Firstly, the game of the present invention involves the use of a hoop and preferably involves the use of a backward spinning motion of the hoop as the hoop passes through a progressively narrowing gate opening. The game of the invention is designated to achieve maximum recreational satisfaction.

I claim:

1. A game for use on the top surface of a table comprising a barrier secured to the surface of said table along a line across said surface, said barrier having two primary sections affixed to said table and spaced apart along said table line to provide a tabletop surface gap between said sections, said primary barrier sections having a pair of gate sections respectively slidably mounted thereto for selective incremental movement together along said line to narrow said gap, and a hoop adapted to be skidded and rolled through the gap between said gate sections.

2. A game in accordance with claim 1 wherein said outer sections are formed in a C-shaped configuration for sliding reception of said inner sections.

3. A game in accordance with claim 2 wherein said hoop is approximately the height of said barrier.

4. A game in accordance with claim 2 wherein said hoop is backspun skiddingly through the gate formed by said inner sections.

5. A game in accordance with claim 4 wherein said hoop has a backspin applied to it as it skids across the table.

* * * * *